US010993040B2

(12) United States Patent
Duan et al.

(10) Patent No.: US 10,993,040 B2
(45) Date of Patent: Apr. 27, 2021

(54) PIEZOELECTRIC MICROPHONE

(71) Applicant: AAC Acoustic Technologies (Shenzhen) Co., Ltd., Shenzhen (CN)

(72) Inventors: Lian Duan, Shenzhen (CN); Rui Zhang, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 5 days.

(21) Appl. No.: 16/702,597

(22) Filed: Dec. 4, 2019

(65) Prior Publication Data

US 2020/0213770 A1 Jul. 2, 2020

(30) Foreign Application Priority Data

Dec. 31, 2018 (CN) ..... 201811650209.7

(51) Int. Cl.
*H04R 31/00* (2006.01)
*H04R 17/02* (2006.01)

(52) U.S. Cl.
CPC ..... *H04R 17/02* (2013.01); *H04R 31/003* (2013.01); *H04R 2231/003* (2013.01)

(58) Field of Classification Search
CPC ..... H04R 17/02; H04R 31/003; H04R 2231/003; H04R 2201/003
See application file for complete search history.

(56) References Cited

U.S. PATENT DOCUMENTS 9,055,372 B2 * 6/2015 Grosh ..... H04R 17/02
2015/0215706 A1 * 7/2015 Sparks ..... B81C 1/00158 381/173
2019/0110132 A1 * 4/2019 Littrell ..... H04R 17/025

FOREIGN PATENT DOCUMENTS

CN 101427591 A1 5/2009
CN 103460721 A1 12/2013

OTHER PUBLICATIONS

PCT search report dated Jan. 8, 2020 by SIPO in related PCT Patent Application No. PCT/CN2019/113281 (4 Pages).

* cited by examiner

*Primary Examiner* — Brian Ensey
(74) *Attorney, Agent, or Firm* — W&G Law Group LLP

(57) ABSTRACT

The present application provides a piezoelectric microphone, and it includes a substrate having a back cavity and a piezoelectric cantilever diaphragm fixed to the substrate. The piezoelectric cantilever diaphragm includes a plurality of diaphragm flaps, and each of the diaphragm flaps has one end fixed to the substrate and another end suspended above the back cavity. Every two adjacent ones of the diaphragm flaps are spaced apart to form a gap. The piezoelectric microphone further comprises an elastically stretchable member connecting the two adjacent diaphragm flaps, and the elastically stretchable member is provided between at least one set of two adjacent ones of the diaphragm flaps. The piezoelectric microphone of the present disclosure has better performance.

10 Claims, 4 Drawing Sheets

30

PIEZOELECTRIC MICROPHONE

TECHNICAL FIELD

The present disclosure relates to the field of electroacoustic conversion, and more particularly, to a piezoelectric microphone.

BACKGROUND

MEMS microphones are now widely used and popularized in consumer electronic products. A conventional MEMS microphone is mainly a condenser microphone, and it includes a substrate, and a back plate and a diaphragm that are formed on the substrate. The diaphragm and the back plate form a capacitor system. Vibration of sound waves will drive the diaphragm of the microphone to vibrate back and forth, and in turn changes a distance between the diaphragm and the back plate and a value of a plate capacitance. By detecting a change in the capacitance, a sound signal can be converted into an electrical signal. When the mobile device is in a dusty environment, particles in air easily enter and get caught between the diaphragm and the back plate of the microphone, such that the diaphragm cannot move; and when the mobile device is in a humid environment, it is easy for water droplets to condense between the diaphragm and the back plate of the microphone, so that the diaphragm and the back plate are adhered by the water droplets. Both of the above conditions can cause the microphone to fail. In order to avoid such problems, piezoelectric MEMS microphones have emerged.

A fabrication process of the piezoelectric microphones is simple, and a design framework employing a single-layer membrane makes it unrestricted by air damping, such that an SNR is naturally improved. In addition, the piezoelectric microphone only includes the diaphragm, and does not include the back plate, which fundamentally eliminates harm caused by the particles and water vapor in the air to the microphone, thereby greatly improving reliability of the microphone.

A diaphragm flap of the diaphragm of many piezoelectric microphones in the related art has one end fixed and one end being a free cantilever structure, and the cantilever structure is used to avoid an influence of residual stress in the process on acoustic performance. When an external sound signal is introduced from a sound hole, a sound pressure causes the cantilever to deform, to generate a voltage change, thereby sensing an acoustic signal.

However, as shown in FIG. 1A and FIG. 1B, in the related art, the free end of the diaphragm flap of the diaphragm 1 will be deformed when the piezoelectric microphone is subjected to a residual stress. Moreover, because of an uneven stress distribution of the entire substrate 2 during a fabricating process, deformation of the free ends of different diaphragm flaps of the diaphragm 1 varies. A structure difference of the diaphragm flaps of the diaphragm 1 further deteriorates the performance of the microphone.

Therefore, it is necessary to provide an improved piezoelectric microphone to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Embodiment 1

Figure 1A:
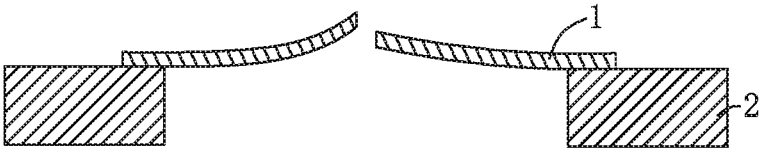
FIG. 1A and FIG. 1B are cross-sectional structural schematic diagrams of a piezoelectric microphone in the related art.
Figure 1B:
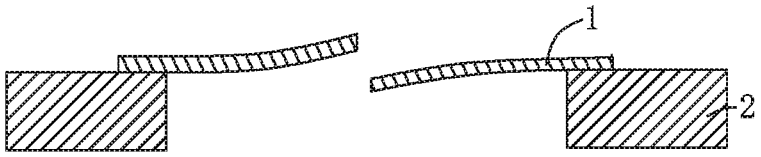
Figure 2:
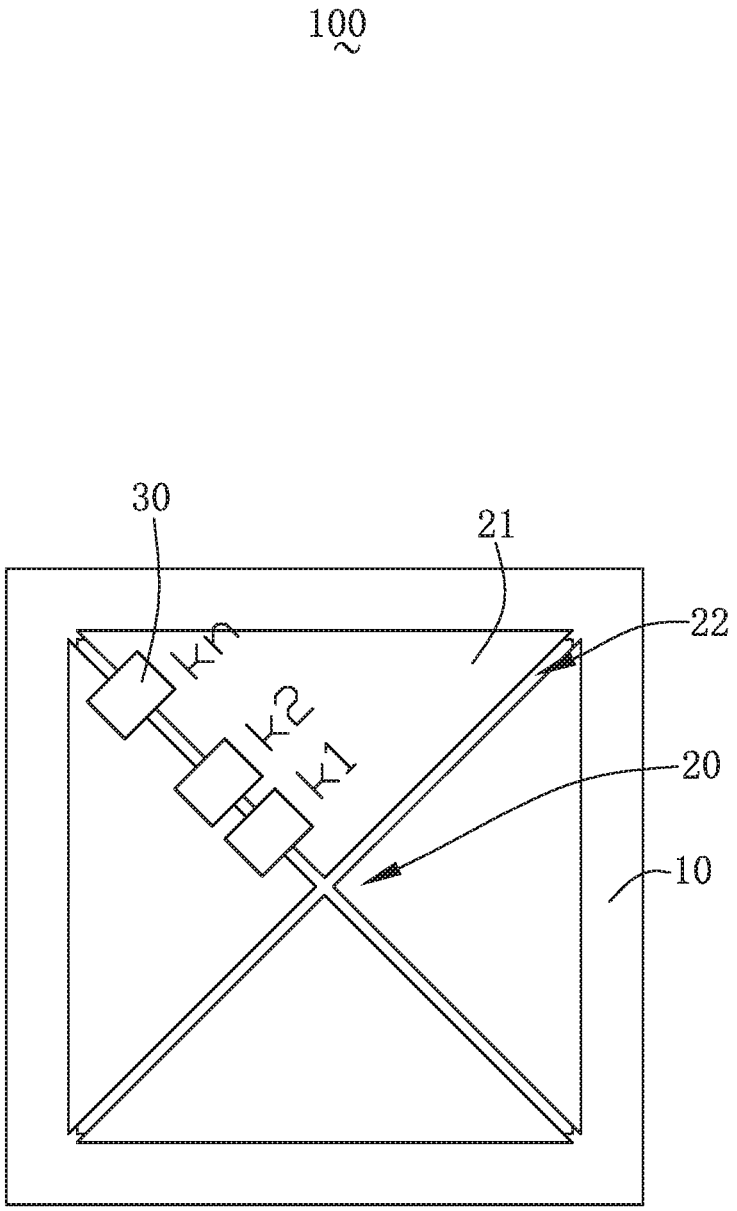
FIG. 2 is a structural schematic diagram of Embodiment 1 of a piezoelectric microphone according to the present disclosure.
Figure 3:
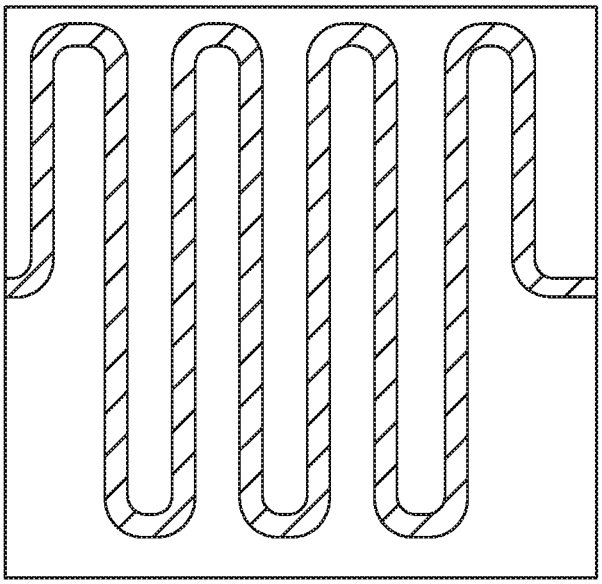
FIG. 3 is a structural schematic diagram of an elastically stretchable member shown in FIG. 2.

Referring to FIG. 2 and FIG. 3, an embodiment provides a piezoelectric microphone 100, and it includes a substrate 10 having a back cavity, a piezoelectric cantilever diaphragm 20 fixed to the substrate 10, and an elastically stretchable member 30 fixed to the piezoelectric cantilever diaphragm 20.

The piezoelectric cantilever diaphragm 20 is composed of a plurality of diaphragm flaps 21. Each of the diaphragm flaps 21 has one end fixed to the substrate 10, and another end suspended above the back cavity. Every two adjacent diaphragm flaps 21 are spaced apart from each other to form a gap 22.

It should be noted that, in this embodiment, four diaphragm flaps 21 are provided, and each of the four diaphragm flaps 21 is structured like a triangle and define the piezoelectric cantilever diaphragm 20 having a rectangular structure. Correspondingly, four gaps 22 are correspondingly provided. In other embodiments, the number of the diaphragm flaps 21 can be any desired number, the diaphragm flaps 21 can be of any shape, and the diaphragm flaps 21 can define the piezoelectric cantilever diaphragm 20 having any shape, which can be selected according to actual needs. In the present embodiment, the case in which the piezoelectric cantilever diaphragm 20 having a rectangular structure is defined by the four triangular diaphragm flaps 21 is described as an example.

The elastically stretchable member 30 is configured to connect two adjacent diaphragm flaps 21, so as to control the gap 22 between the two adjacent diaphragm flaps 21, and to restrict the adjacent diaphragm flaps 21 in the same plane.

A plurality of elastically stretchable members 30 is provided, and the plurality of elastically stretchable members 30 is located between two adjacent diaphragm flaps 21 of the same set.

These elastically stretchable members 30 are sequentially arranged at intervals along an arrangement direction of the gap 22 formed by the two adjacent diaphragm flaps 21. That is, a distance between every two adjacent elastically stretchable members 30 is identical.

Structural dimensions of the plurality of elastically stretchable members 30 are the same, and the elastically stretchable members 30 are all shaped like a rectangle or sector. In this embodiment, the elastically stretchable members 30 are all of a rectangular structure.

Each of the elastically stretchable members 30 is formed by one or more springs. Preferably, the elastically stretchable member 30 is formed by one or more torsion springs.

Thus, a torque and an elastically force can be controlled to narrow the gap 22 formed between the two adjacent diaphragm flaps 21.

It should be noted that, in this embodiment, a plurality of elastically stretchable members 30 is provided, and these elastically stretchable members 30 are located between two adjacent diaphragm flaps 21 of the same set. In other embodiments, only one elastically stretchable member 30 may be provided, and it is distributed between two adjacent diaphragm flaps 21, or a plurality of elastically stretchable members 30 may be provided and respectively distributed between different sets of two adjacent diaphragm flaps 21. For example, at least one elastically stretchable member 30 is provided between every two adjacent diaphragm flaps 21, and a quantity of the at least one elastically stretchable member 30 provided between every two adjacent ones of the diaphragm flaps 21 is identical.

In this embodiment, the elastically stretchable members 30 are sequentially arranged at intervals, and a spacing distance between every two adjacent elastically stretchable members 30 is identical. In other embodiments, the elastically stretchable members 30 may be sequentially arranged at an increasing or decreasing interval, or at random intervals.

In this embodiment, the elastically stretchable members 30 are all rectangular structures of the same size. In other embodiments, the elastically stretchable members 30 may be structures of any shapes having different sizes.

In the present embodiment, the elastically stretchable member 30 is formed by one or a combination of more of elastically springs or torsion springs. In other embodiments, the elastically stretchable member 30 can be composed of any other structure(s) having a function of adjusting the gap 22 between two adjacent diaphragm flaps 21.

That is, the number, distribution position, arrangement manner, structural shape and material composition of the elastically stretchable members 30 are not limited in the present disclosure, as long as the elastically stretchable members 30 can have the function to adjust the gap 22 between two adjacent ones of the diaphragm flaps 21 and can limit the plane where the two adjacent diaphragm flaps 21 are located. The number, distribution position, arrangement manner, structural shape and material composition of the elastically stretchable members 30 can be selected according to actual needs.

Embodiment 2

Figure 4:
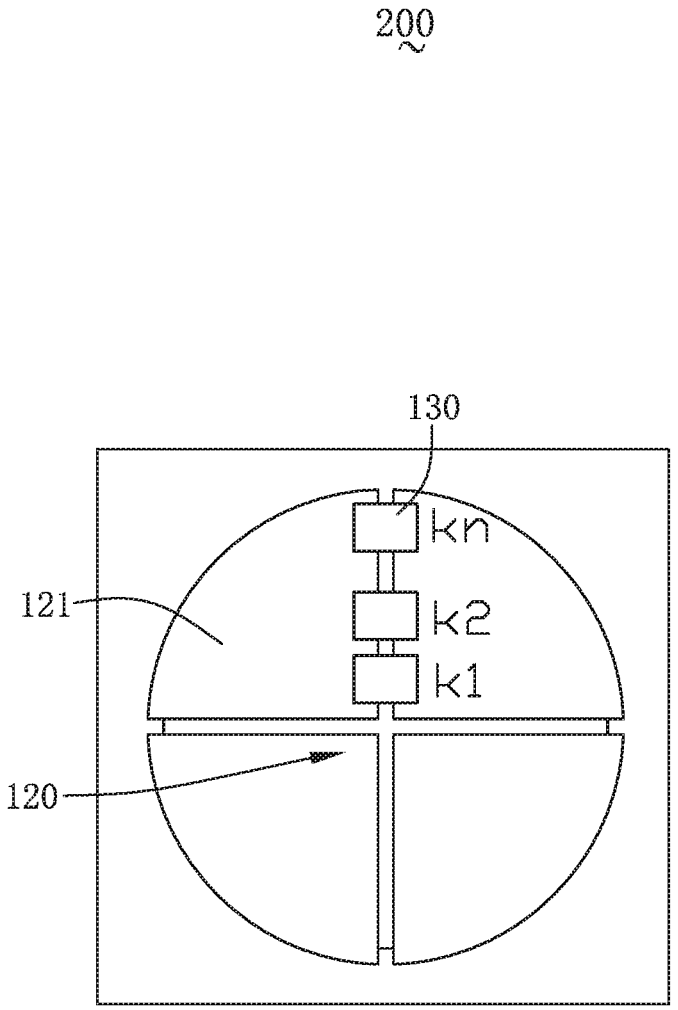
FIG. 4 is a structural schematic diagram of Embodiment 2 of a piezoelectric microphone according to the present disclosure.

Referring to FIG. 4, an embodiment provides a piezoelectric microphone 200. The piezoelectric microphone 200 is basically structured the same as the piezoelectric microphone 100 in Embodiment 1, and a difference lies in:

The piezoelectric cantilever diaphragm 120 of the piezoelectric microphone 200 is composed of four sector-shaped diaphragm flaps 121, and the four diaphragm flaps 121 define the piezoelectric cantilever diaphragm 120 having a circular structure. A plurality of elastically stretchable members 130 is provided, and these elastically stretchable members 130 are sequentially arranged at intervals between two adjacent diaphragm flaps 121 of the same set.

Compared with the related art, the piezoelectric microphone of the present disclosure is provided with the elastically stretchable members between two adjacent diaphragm flaps of at least one set to connect the two adjacent diaphragm flaps, and the elastically stretchable members can restrict the adjacent diaphragm flaps in the same plane, and can well control the elastically force and the torque, such that the gap between the diaphragm flaps is narrowed to achieve a purpose of controlling the spacing between the adjacent diaphragm flaps, thereby improving the uniformity of the product and thus improving the consistency of the product, making the piezoelectric microphone have a better working performance.

What has been described above are merely embodiments of the present disclosure, and it should be noted herein that one ordinary person skilled in the art can make improvements without departing from the inventive concept of the present disclosure, but these are all within the scope of the present disclosure.

What is claimed is:

1. A piezoelectric microphone, comprising:

a substrate having a back cavity;

a piezoelectric cantilever diaphragm fixed to the substrate and comprising a plurality of diaphragm flaps, wherein each of the plurality of diaphragm flaps has one end fixed to the substrate and another end suspended above the back cavity, and every two adjacent ones of the plurality of diaphragm flaps are spaced apart from each other to form a gap; and one or more elastically stretchable members each connecting two adjacent ones of the plurality of diaphragm flaps, wherein the one or more elastically stretchable members are provided between at least one set of two adjacent ones of the plurality of diaphragm flaps.

2. The piezoelectric microphone as described in claim 1, wherein the one or more elastically stretchable members comprise a plurality of elastically stretchable members, and the plurality of elastically stretchable members is located between a same set of two adjacent ones of the diaphragm flaps, and is arranged at intervals along an arrangement direction of the gap formed by the two adjacent diaphragm flaps.

3. The piezoelectric microphone as described in claim 2, wherein a distance between every two adjacent ones of the plurality of elastically stretchable members is identical.

4. The piezoelectric microphone as described in claim 2, wherein structural dimensions of the plurality of the elastically stretchable members are identical.

5. The piezoelectric microphone as described in claim 1, wherein each of the one or more elastically stretchable members has a rectangular shape or a sector shape.

6. The piezoelectric microphone as described in claim 1, wherein each of the one or more elastically stretchable members is formed by one or more springs.

7. The piezoelectric microphone as described in claim 6, wherein each of the one or more elastically stretchable members is formed by one or more torsion springs.

8. The piezoelectric microphone as described in claim 1, wherein the plurality of diaphragm flaps comprises four diaphragm flaps, each of the four diaphragm flaps is of a triangular structure, and the four diaphragm flaps define the piezoelectric cantilever diaphragm having a rectangular structure.

9. The piezoelectric microphone as described in claim 1, wherein the plurality of diaphragm flaps comprises four diaphragm flaps, each of the four diaphragm flaps is of a sector-shaped structure, and the four diaphragm flaps define the piezoelectric cantilever diaphragm having a circular structure.

10. The piezoelectric microphone as described in claim 1, wherein at least one elastically stretchable member of the one or more elastically stretchable members is provided between every two adjacent ones of the plurality of diaphragm flaps, and a quantity of the at least one elastically stretchable member provided between every two adjacent ones of the plurality of diaphragm flaps is identical.

* * * * *